US005445420A

United States Patent [19]

Lairmore et al.

[11] Patent Number: 5,445,420

[45] Date of Patent: Aug. 29, 1995

[54] FOOTPRINT CONFIGURATION SPONGE AND BASE NOVELTY DEVICE

[76] Inventors: Arley G. Lairmore, 1623 W. Denton La. #102, Phoenix, Ariz. 85015; Lisa M. Lairmore, 11248 N. Biltmore Dr. #111, Phoenix, Ariz. 85029

[21] Appl. No.: 179,531

[22] Filed: Jan. 10, 1994

[51] Int. Cl.[6] ..... B42D 15/00

[52] U.S. Cl. ..... 283/117; 283/56

[58] Field of Search ..... 462/1; 281/51; 283/56, 283/11.7; D32/40, 42, 43, 35; 15/244.1

[56] References Cited

U.S. PATENT DOCUMENTS

| | | | |
|---|---|---|---|
| D. 311,274 | 10/1990 | Laury | D3/61 |
| D. 311,451 | 10/1990 | Chan | D3/62 |
| D. 353,239 | 12/1994 | Briscoe | D32/43 X |
| 2,694,844 | 11/1954 | Grumbach | 24/73 |
| 3,289,215 | 12/1966 | Kennedy | 15/244.1 |
| 3,750,226 | 8/1973 | Morgan | 15/244.1 X |
| 4,683,592 | 8/1987 | Strongwater | 2/17 |
| 4,747,175 | 5/1988 | Durgin | 15/105 |
| 5,099,541 | 3/1992 | Tressler | 15/244.1 X |

*Primary Examiner*—Willmon Fridie

[57] ABSTRACT

A combination ice scraper-sponge novelty device has a flat, acrylic base with a transparent top surface displaying a footprint configuration embedded therein. A theme message is imprinted within the footprint configuration relating to pacifying foot stomping on the floorboard of an automobile. A sponge with side edges having the same shape as the footprint configuration displayed on the base, is releaseably attached to the base so that the sponge generally overlies the footprint configuration of the base. Some base side edges may be formed into portions of the footprint configuration. The novelty device may function as an ice scraper or a key ring.

19 Claims, 2 Drawing Sheets

FOOTPRINT CONFIGURATION SPONGE AND BASE NOVELTY DEVICE

BACKGROUND OF THE INVENTION

1. Fields of the Invention

The present invention relates generally to a novelty device, and more particularly, to a base-sponge novelty device in which a characteristic silhouette shape and related theme message is embedded in and visible through the base over which is releaseably attached the similarly theme shaped sponge. The base and sponge have independent additional utility.

2. Discussion of Background and Prior Art

Novelty devices are designed for personal or household decoration and many types of novelty devices presently exist on the market. A novelty device typically has an ornamental feature, a functional feature, and a theme. The ornamental feature provides a design for the device, and the theme may relate to any subject that the designer wants to convey. The functional feature of the novelty device may vary widely depending on the designer's choice. Presently, a novelty device that has abase having a footprint configuration displayed on the front surface, a sponge having the same shape as the footprint configuration on the front surface of the base, and attachment means between the base and the sponge for attaching the sponge to the base so that the sponge generally overlies the footprint configuration on the front surface of the base, does not exist on the market.

As stated earlier, a novelty device may convey a particular theme. One theme that has not been conveyed on novelty devices relates to automobile drivers who follow or tailgate other drives too closely. As is well known, tailgaters cause the passenger sitting next to the driver to frequently react by stomping a foot on the floor board of the automobile. This "foot stomping" acts as a signal for the driver to slow the car down. Presently, a novelty device in general which conveys a theme message relating to pacifying foot stomping on a floor board of an automobile in a base having a footprint configuration and a sponge generally with the same footprint configuration overlying and attached to the base does not exist on the market.

In the past, combination devices have been provided which have independent functional utility, including ice scrapers. One prior art ice scraper included a scraping blade, a handle, and a mitt attached to the handle for protecting the users hand from the ice or cold. Another prior art ice scraper had an optional feature of an attachment means on the base of the ice scraper for allowing the ice scraper to be mounted for storage. Presently, however, a combination novelty device having an ice scraper as its independently functional base with a foot stomping theme displayed on the front surface, and a releaseably attached overlying functional sponge having generally the same theme related shape.

Key rings or key chains have also been used as novelty devices. Key rings typically include an ornamental base and a key ring attached to the base. The ornamental base may vary in design, shape, or theme according to the designer's choice. Some examples of prior art ornamental base designs for key rings are a bottom of a shoe or sneaker, a hand, a fish, a car, a number, and a snowboard. Presently, however, a key ring novelty device having a key ring base with a footprint configuration displayed on the front surface, a sponge having generally the same shape as the footprint configuration, and attachment means for attaching the sponge to the base so that the sponge generally overlies the footprint configuration displayed on the base, does not exist on the market. Furthermore, the key ring novelty device that has just been described above having a theme, such as pacifying foot stomping on a floorboard of an automobile, also does not exist.

In overcoming the problems and limitations of the prior art, it is an object of the present invention to provide a combination novelty device that has a base and overlying releaseably attached sponge presenting an integrated theme message with the base and sponge each having independent functional utility.

It is a further object of the present invention to provide a novelty device wherein the independent utility of the base is an ice scraper or key ring and the sponge can function independently as a sponge.

It is still another feature of the invention to provide a novelty device in which a theme message is imbedded in and visible through the base of the device and, in particular, the theme message relates to the pacifying of foot stomping on the floorboard of an automobile.

It is a further object of the present invention to provide a two piece combination novelty device in which the base has a footprint configuration displayed on the front surface, to which is releasably attached a sponge having the same shape as the footprint configuration displayed on the base.

It is another object of the invention to provide a base of the novelty device in which some side edges that are formed into portions of the footprint configuration on the base.

SUMMARY OF THE INVENTION

Set forth below is a brief summary of the invention in order to solve the foregoing problems and achieve the foregoing and other objects, benefits, and advantages in accordance with the purpose of the present invention as embodied and broadly described herein.

One aspect of the invention is a novelty device having a base with a footprint configuration displayed on the front surface, a sponge having the same shape as the footprint configuration displayed on the base, and releasable attachment means for attaching the sponge to the base so that the sponge generally overlies the footprint configuration displayed on the base.

Another feature of this aspect of the invention is the base having some side edges that are formed into portions of the footprint configuration.

Another feature of this aspect of the invention is the base having a printed theme message, and in particular, a printed theme message relating to pacifying foot stomping on a floorboard of an automobile.

Another feature of this aspect of the invention is the novelty device having an ice scraper or key ring as its base.

A further feature of this aspect of the invention is attachment means located on the back surface of the base for mounting the base to a support, which allows the device to be hung or stored.

DETAILED DESCRIPTION OF THE INVENTION

Figure 1:
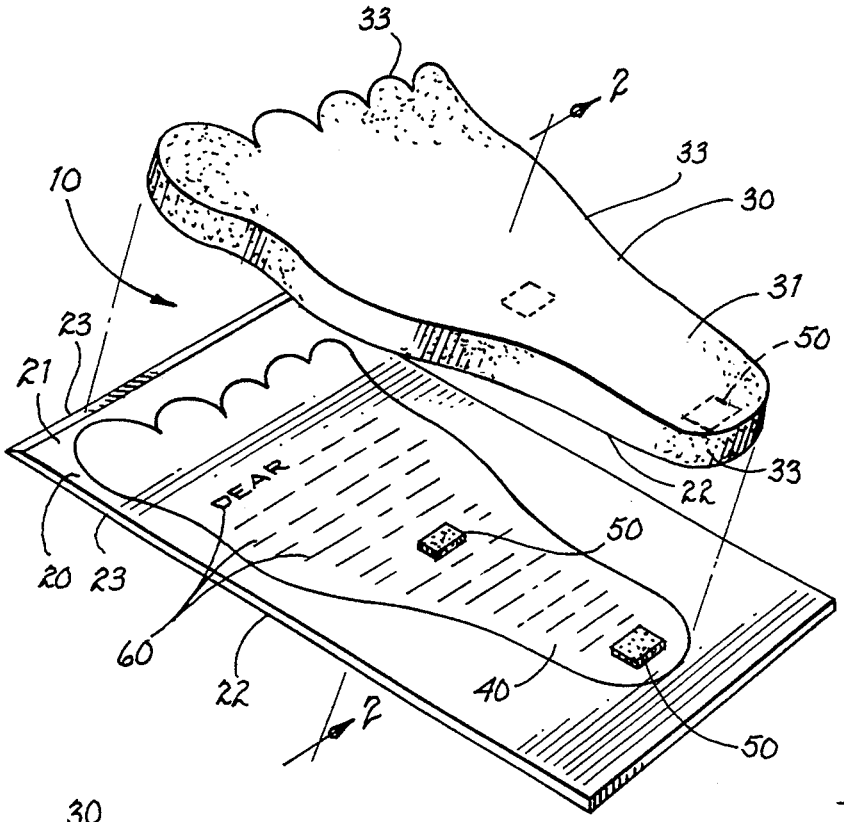
FIG. 1—Perspective view of a preferred embodiment footprint configuration sponge and base novelty device having an ice scraper as the base.
Figure 5:
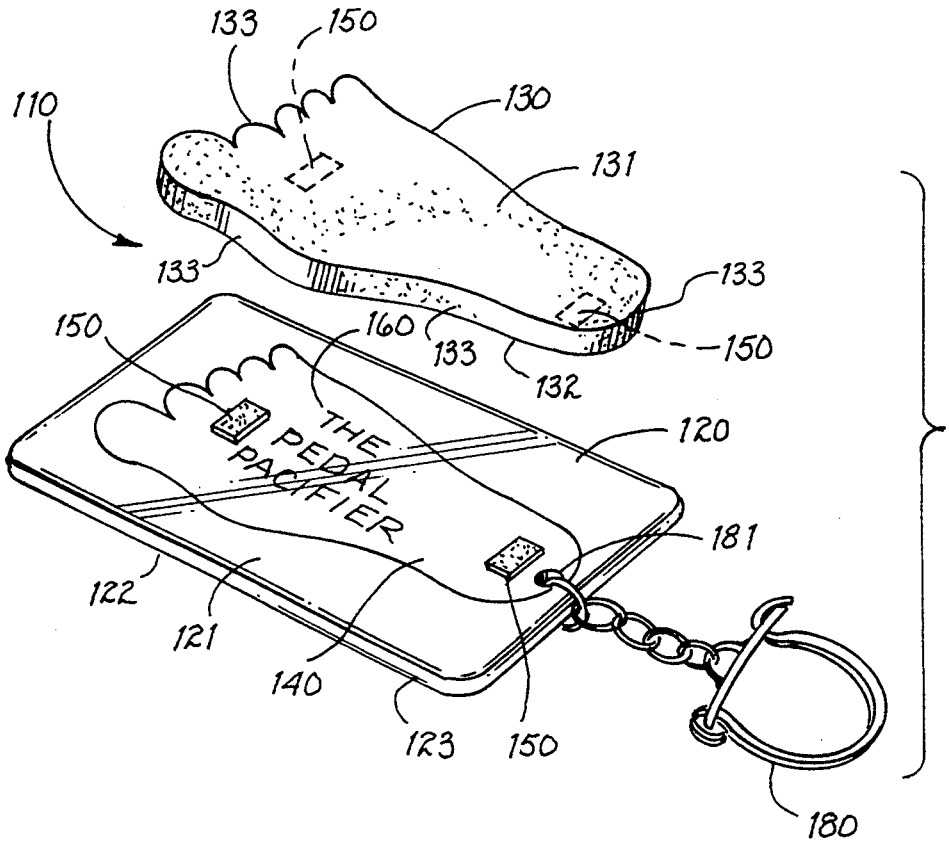
FIG. 5—Perspective view of a second embodiment footprint configuration sponge and novelty device having a key ring base.

FIGS. 1 and 5 respectively show perspective views of a first embodiment novelty device 10 and a second embodiment novelty device 110. Both of these novelty device embodiments include a base with a footprint configuration displayed on the front surface, a sponge having the same shape as the footprint configuration displayed on the base, and attachment means for attaching the sponge to the base so that the sponge generally overlies the footprint configuration displayed on the base. These two embodiments are now described in more detail.

The First Embodiment

Figure 2:
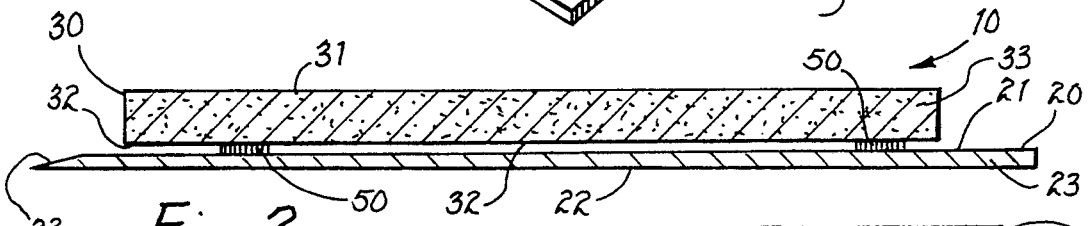
FIG. 2—Side plan view taken along the line 2—2 of FIG. 1.
Figure 4:
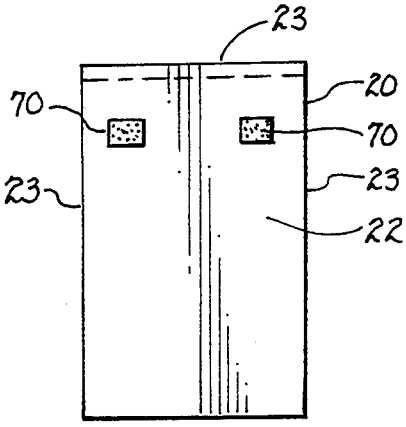
FIG. 4—Bottom plan view of FIG. 1.

As seen in FIGS. 1 and 2, a preferred embodiment 10 of the footprint configuration sponge and base novelty device includes a base 20 with a footprint configuration 40 displayed on the front or top surface 21, a sponge 30 having the same shape as the footprint configuration 40, and attachment means 50 located between the base 20 and sponge 30 for attaching the sponge 30 to base 20.

In the preferred embodiment, base 20 is an ice scraper. Base 20 has a front or top surface 21 and a back or bottom surface 22. These surfaces 21 and 22 may vary in shape or configuration, but FIG. 1 shows these surfaces 21 and 22 to be generally flat surfaces. Base 20 is preferably made from clear acrylic plastic material. A footprint configuration 40 is either located on or embedded in the acrylic plastic base 20, and it is displayed on or through the front surface 21 of the base 20.

Base 20 also has side edges 23. These side edges 23 make up the rectangular base as shown in FIG. 1, and the side edge 23 of the rectangular base is the edge used for scraping the ice. It is flat and sharp. The novelty device with a rectangular base 20 is one species of the preferred embodiment of the present invention.

Figure 3:
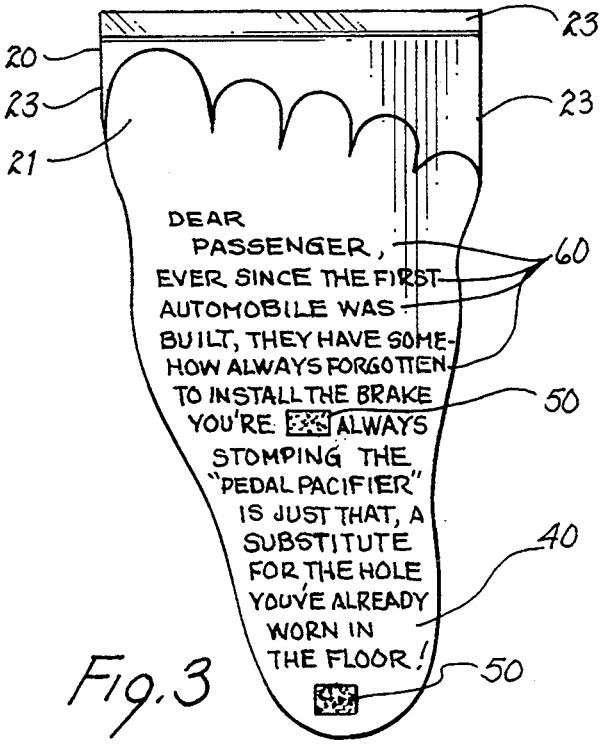
FIG. 3—Top plan view of a modified base of FIG. 1 having some side edges formed into portions of the footprint configuration.

Alternatively, base 20 may have some of its edges 23 formed into portions of the footprint configuration 40. FIG. 3 shows the preferred embodiment novelty device 10 with some side edges 23 of base 20 shaped into a portion of the footprint configuration 40. The side edges 23 are preferably shaped into the heel portion of the footprint configuration 40 by cutting or sanding them to the desired configuration. The novelty device with a base 20 shaped in this manner defines a second species of the preferred embodiment of the present invention.

A printed theme message 60 may also be displayed within footprint configuration 40 in FIG. 3. As discussed earlier, automobile drivers who follow too closely may cause passengers sitting near the driver to react by stomping their foot on the floorboard of the automobile. The foot stomping acts as a signal for the driver to slow the car down. Therefore, the theme message 60 may relate to the pacifying of foot stomping on a floorboard of an automobile. In particular, as shown in FIG. 3, the theme message 60 relates to the driver responding to the passenger's foot stomping by stating, "DEAR PASSENGER, EVER SINCE THE FIRST AUTOMOBILE WAS BUILT, THEY HAVE SOMEHOW ALWAYS FORGOTTEN TO INSTALL THE BRAKE YOU'RE ALWAYS STOMPING. THE "PEDAL PACIFIER" IS JUST THAT, A SUBSTITUTE FOR THE HOLE YOU'VE ALREADY WORN IN THE FLOOR!" Thus, the theme message and base configuration are coordinated with each other.

Sponge 30 has a shape which further coordinates with the theme message. In the preferred embodiment, sponge 30 has a front or top surface 31, a back or bottom surface 32 and side edges 33 which have the same shape as the footprint configuration 40 displayed on the front surface 21 of the base 20. Thus, the entire combination of base 20, sponge 30, message 60, and footprint configuration 40 of both base and sponge form a single, integrated theme.

Attachment means 50 are placed between the sponge 30 and base 20 so that the sponge 30 is attached to the base 20 and the sponge 30 generally overlies the footprint configuration 40 displayed on the front surface 21. As shown in FIG. 1, attachment means 50 are placed on the front surface 21 of base 20 and on the back surface 33 of the sponge 30. Releaseable attachment means 50 may be adhesive-backed velcro fastening strips in which the strips may adhere to each other upon contact and may also be detached from each other.

Sponge 30 is placed on base 20 so that it generally overlies the footprint configuration 40, and sponge 30 releaseably attaches to base 20 by attachment means 50 on back surface 33 contacting attachment means 50 on front surface 21. FIG. 2 shows sponge 30 attached to base 20. Attachment means 50 also allows sponge 30 to be detached from base 20.

Optionally, attachment means 70 is secured to the back surface 22 of base 20 for mounting to some type of support, such as, attaching the novelty device to the carpet of an automobile (i.e. convenience for the driver to store the ice scraper). Attachment means 70 may also be adhesive-backed velcro fastening strips in which the strips adhere to each other upon contact and may also be detached from each other, thereby permitting their separate independent functional use as an ice scraper or sponge, respectively.

The Second Embodiment

Figure 6:
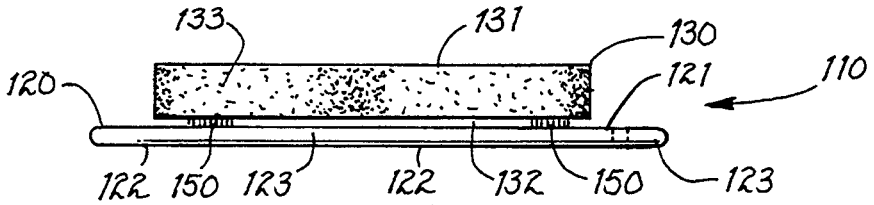
FIG. 6—Side plan view of FIG. 5.

As seen in FIGS. 5 and 6, a second embodiment 110 of the footprint configuration sponge and base novelty device combination includes a base 120 with a footprint configuration 140 displayed on the front surface 121, a sponge 130 having the same shape as the footprint configuration 140, and attachment means 150 located between the base 120 and sponge 130 for releaseably attaching the sponge 130 to the base 120.

In this second embodiment, the novelty device is a key ring, and base 120 is the key ring base. As shown in FIG. 5, base 120 has a front surface 121, a back surface 122 and side edges 123. Front and back surfaces 121 and 122 are generally flat surfaces, and side edges 123 make up the rectangular key ring base as shown in FIG. 5. A key ring component 180 is attached to base 120 through hole 181, and the key ring component 180 may hold any number of keys or sets of keys together. Base 120 may also be made from clear acrylic, plastic material. A footprint configuration 140 is either located on or in the acrylic plastic base 20, and it is displayed on or through the front surface 121 of the base 120. Side edges 123 may also be alternatively shaped in the same manner as discussed for the first embodiment (i.e. some side edges 123 are shaped into a heel portion of the footprint configuration 140).

Figure 7:
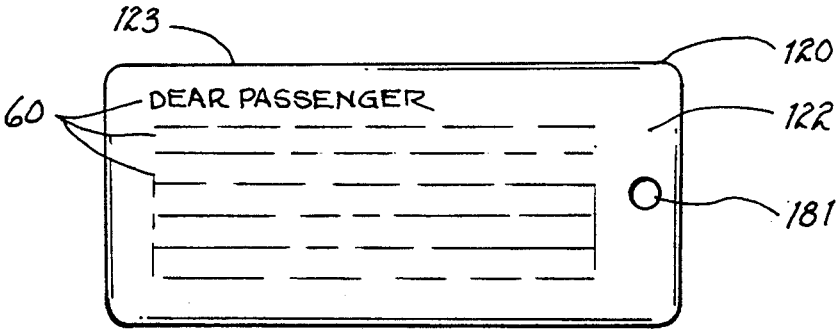
FIG. 7—Bottom plan view of FIG. 5.

A name, title, or trademark 160 of the novelty device or a printed theme message 60 may be displayed on the footprint configuration 140 as shown in FIG. 5. The theme message 60 may be the same theme message relating to pacifying foot stomping on a floorboard of an automobile as was discussed earlier for the first embodiment. Alternatively, the printed theme message 60 may be displayed on the back surface 122 of base 120, as shown in FIG. 7.

Sponge 130 has a front surface 131, a back surface 132 and side edges 133 which have the same shape as the footprint configuration 140 displayed on the front surface 121 of the base 120.

Attachment means 150 are placed between the sponge 130 and base 120 so that the sponge 130 is attached to the base 120 and the sponge 130 generally overlies the footprint configuration 140 displayed on the front surface 121. As shown in FIG. 5, attachment means 150 are placed on the front surface 121 of base 120 and on the back surface 133 of the sponge 130. Attachment means 150 may be adhesive-backed velcro fastening strips in which the strips may adhere to each other upon contact and may also be detached from each other.

Sponge 130 is placed on base 120 so the sponge generally overlies the footprint configuration 140, and sponge 130 attaches to base 120 by attachment means 150 on back surface 133 contacting the attachment means 150 on front surface 121. FIG. 6 shows sponge 130 attached to base 120. Attachment means 150 also allows sponge 130 to be detached from base 120.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed:

1. A novelty device which comprises:

a base having a front surface, a back surface, and a footprint configuration displayed on the front surface;

a sponge having a front surface, a back surface and side edges having the same shape as the footprint configuration displayed on the front surface of the base; and attachment means between the sponge and base for releaseably attaching the sponge to the base so that the sponge generally overlies the footprint configuration displayed on the front surface of the base.

2. The novelty device according to claim 1 wherein:

the front surface and back surface of the base are generally flat.

3. The novelty device according to claim 2 wherein:

the base is made from an acrylic plastic material.

4. The novelty device according to claim 3 wherein:

the base is an ice scraper.

5. The novelty device according to claim 3 wherein:

the base is a key ring base.

6. The novelty device according to claim 1 further comprising::

a printed theme message displayed within the footprint configuration.

7. The novelty device according to claim 6 wherein:

the printed theme message relates to pacifying foot stomping on a floor board of an automobile.

8. The novelty device according to claim 1 wherein:

the base has side edges between the front surface and the back surface at least some of the edges of which form portions of the footprint configuration.

9. The novelty device according to claim 1 wherein:

the attachment means are mounted on the front surface of the base and on the back surface of the sponge.

10. The novelty device according to claim 9 further comprising:

attachment means secured to the back surface of the base for mounting the base to a support.

11. The novelty device according to claim 10 wherein:

the attachment means are adhesive-backed velcro fastening strips.

12. An ice scraper-sponge combination novelty device comprising:

a flat, acrylic base having a transparent top surface, a back surface and side edges therebetween at least one of which is flat and sharp;

a silhouette of a foot and a printed theme message within the silhouette relating to pacifying foot stomping on a floorboard of an automobile imbedded in the base and visible through the top surface;

a foot shaped sponge, and means for releaseably attaching the sponge to the top surface of the base to .overlie the foot silhouette in the base.

13. The device of claim 12 wherein:

some side edges form some portions of the foot silhouette.

14. A method for making a novelty device that comprises the steps of:

providing a base having a front surface, and a back surface;

displaying a footprint configuration on the front surface;

forming a sponge having a front surface, a back surface, and side edges into the same shape as the footprint configuration displayed on the front surface of the base; and releaseably attaching the sponge to the base so that the sponge generally overlies the footprint configuration displayed on the front surface of the base.

15. The method for making a novelty device according to claim 14 further comprising the step of:

displaying a printed theme message on the front surface of the base.

16. The method for making a novelty device according to claim 15 wherein the step of displaying a printed theme message further comprises the step of:

relating the printed theme message to a person stomping a foot on a floorboard of an automobile.

17. The method for making a novelty device according to claim 14 wherein the base has side edges between the front surface and the back surface and the displaying step further comprises the step of:

forming some of the side edges of the base into at least part of the footprint configuration.

18. The method for making a novelty device according to claim 17 wherein the step of providing a base further comprises the step of:

forming a flat, sharp side edge adapted for scraping ice.

19. The method for making a novelty device according to claim 18 wherein the step of providing a base further comprises the step of:

forming the base at least in part of transparent acrylic material; and embedding the footprint configuration in the transparent base portion.

* * * * *